US005716239A

United States Patent [19]

Olson

[11] Patent Number: 5,716,239

[45] Date of Patent: Feb. 10, 1998

[54] ELECTRICAL CONNECTOR USING COMPOSITE BEAM WITH LOW INITIAL DEFLECTION RATE

[75] Inventor: Stanley Wayne Olson, East Berlin, Pa.

[73] Assignee: Berg Technology, Inc., Reno, Nev.

[21] Appl. No.: 657,000

[22] Filed: May 28, 1996

Related U.S. Application Data

[63] Continuation of Ser. No. 193,443, Feb. 8, 1994, abandoned.

[51] Int. Cl.[6] ..... H01R 13/10

[52] U.S. Cl. ..... 439/682; 439/465; 439/751

[58] Field of Search ..... 439/682, 691, 439/841, 843, 851, 852, 861, 862, 660, 686, 274, 267, 465, 751

[56] References Cited

U.S. PATENT DOCUMENTS

| | | | |
|---|---|---|---|
| 3,748,633 | 7/1973 | Lundergan | 439/682 |
| 3,963,293 | 6/1976 | McKee | 439/62 |
| 4,023,879 | 5/1977 | Braund et al. | 439/76 |
| 4,033,658 | 7/1977 | Asick | 439/218 |
| 4,036,544 | 7/1977 | Keglewitsch . | |
| 4,217,024 | 8/1980 | Aldridge et al. | 439/682 |
| 4,306,761 | 12/1981 | Ress, Jr. | 439/862 |
| 4,420,215 | 12/1983 | Tengler . | |
| 5,074,039 | 12/1991 | Hillbish et al. | 29/883 |
| 5,131,872 | 7/1992 | Consoli et al. | 439/862 |
| 5,133,679 | 7/1992 | Fusselman et al. | 439/608 |
| 5,213,514 | 5/1993 | Arai | 439/79 |
| 5,236,368 | 8/1993 | Adams et al. | 439/79 |
| 5,259,793 | 11/1993 | Yamada et al. | 439/637 |

FOREIGN PATENT DOCUMENTS

| | | | |
|---|---|---|---|
| 0879968 | 10/1961 | United Kingdom | 439/682 |

*Primary Examiner*—Hien Vu

*Attorney, Agent, or Firm*—Woodcock Washburn Kurtz Mackiewicz & Norris LLP

[57] ABSTRACT

An electrical connector assembly according to the current invention comprises a receptacle and a composite action beam. The composite action beam is located in the receptacle and has a movable end and a fixed end. During initial phase of insertion cycle, a movable end of the composite action beam moves as the pin is inserted into the connector. This movement reduces insertion force. During an intermediate phase of the insertion cycle, the movable end reaches the inside wall of the connector and the composite action beam now functions as a two-end supported beam. The composite action beam thereon exerts sufficiently high normal force against the inserted pin so as to retain the pin in the inserted position. Thus, the composite action beam reduces insertion force without compromising normal force once the pin is inserted.

6 Claims, 3 Drawing Sheets

ELECTRICAL CONNECTOR USING COMPOSITE BEAM WITH LOW INITIAL DEFLECTION RATE

This is a continuation of application Ser. No. 08/193,443, filed Feb. 8, 1994 now abandoned.

FIELD OF THE INVENTION

This invention relates to the field of electrical connectors and more particularly to miniature or high density connectors which require low insertion forces and high normal forces.

BACKGROUND OF THE INVENTION

In electrical connector design, miniaturization has been an important consideration. However, there is a trade off between connector performance and a reduced size. As the size of the connector reduces, less space is available within the connector for a connector beam. Such a limited space does not allow the connector beam to provide low insertion force relative to high normal force with the ability to handle tolerances.

In a compact connector, the above-mentioned low insertion force is a significant design factor. As the area required for each pin-to-beam contact is reduced, more contact may be placed in the connector. Heretofore, more force was necessary for inserting a component with such a connector. Such increased insertion force, particularly where the connector has already been mounted on a printed circuit board, can result in bending of the printed board and subsequent solder joint cracking.

Cantilever beams have been used in the art to provide low insertion force. The cantilever beam is generally supported only by one end so that the other end can move during a pin insertion cycle. When a pin is initially inserted into a connector receptacle, the pin touches the movable end of the beam. When the pin is further inserted, the movable end is pushed away in a substantially vertical direction to an axis of insertion to accommodate the penetration of the pin. This movement allows low insertion force for an easy insertion. However, when the pin is completely inserted into the connector, a cantilever beam that is thin enough to handle the required deflection does not provide a high enough normal force against the inserted pin to maintain long term electrical integrity.

On the other hand, a supported beam provides high normal force against a completely inserted pin. Since the supported beam is generally supported by both ends, unlike a cantilever beam, either end of the supported beam does not move in a substantially vertical direction. During the pin insertion cycle, the supported beam only deflects. Accordingly, the supported beam tends to require high insertion force during an initial phase of an insertion cycle. Since a compact connector assembly may accommodate a large number of contacts, the total amount of necessary insertion force is undesirably high.

Neither a cantilever beam nor a supported beam alone may be appropriate for a compact connector for the above mentioned reasons. A cantilever beam may provide low initial insertion force, but may not provide sufficient normal force against a completely inserted pin. A cantilever beam also requires a larger space for the movable end. A supported beam, on the other hand, may provide sufficient normal force against an inserted pin, but requires large insertion force during an initial phase of an insertion cycle. Accordingly, a large number of pins cannot be placed on the same connector with supported beams due to its larger insertion force.

SUMMARY OF THE INVENTION

Accordingly, the current invention provides a compact electrical connector with low insertion force relative to high normal force with the ability to handle tolerances. Thus, one object of the current invention is to limit height, width and pitch of a connector. Another object is to provide low insertion force at least during an initial phase of an insertion cycle. Yet another object of the current invention is to provide high normal force against the inserted pin. Lastly, another object of the invention is to provide the ability to handle tolerances during all phases of the manufacturing and use of the connector.

According to one aspect of the current invention, an electrical connector assembly for electrically connecting a pin comprises a receptacle having a bore along an axis of receiving the pin, the bore having inner walls; and a composite action beam located in the bore for providing a substantially low insertion force or low spring rate during the initial phase of insertion of the pin and providing a substantially high normal force against the pin during a later phase of the insertion.

According to another aspect of the current application, the composite action beam has a unsupported end and a supported end. The composite action beam performs the steps providing a substantially low insertion force while the pin being inserted at the unsupported end during an initial phase of the insertion, the composite action beam functioning as a cantilever beam during the initial phase; abutting the unsupported end against one of the inner walls during a later phase of the insertion, the composite action beam then functioning as a supported beam during the later phase; and providing a substantially high normal force against the pin.

According to a third aspect of the invention, an electrical connector assembly for electrically connecting a pin comprises a receptacle having a bore along an axis of receiving the pin, the bore having inner walls, one of the inner walls having a partially indented surface; a composite action beam located in said the having a unsupported end and a supported end, the pin being inserted at the unsupported end during an initial phase of an insertion, the composite action beam functioning as a cantilever beam so as to allow a substantially low deflection rate during said initial phase, the unsupported end reaching said partially indented surface and abutting against the partially indented surface during a later phase of the insertion, the composite action beam then functioning as a supported beam during the later phase so as to provide a substantially high normal force against the pin; whereby said partially indented surface making an outer width of said receptacle thinner.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1A:
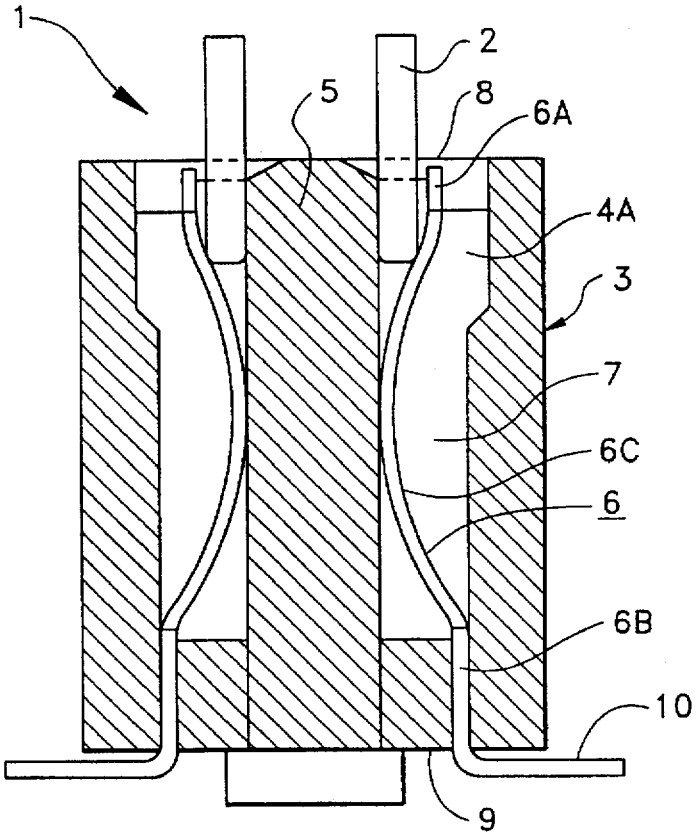
FIG. 1A diagrammatically illustrates a cross-section of a preferred embodiment of a miniature connector and a pin according to the current invention during an initial phase of an insertion cycle.

Referring now to the drawings, wherein like reference numerals designate corresponding structure throughout the views.

FIG. 1A shows a cross sectional view of one preferred embodiment of a compact connector assembly according to the current invention. The assembly 1 comprises a pin 2 and a compact connector or receptacle 3. The compact connector 3 further comprises a side wall 4 middle/insertion wall 5 and an electrically-conductive composite action beam 6. The insertion wall 5 has two opposing insertion surfaces 5*a*. The composite action beam 6 is located in a bore 7 which is limited by the insertion wall 5 and the sidewall 4. A movable or unsupported end 6A of the composite action beam 6 is located near a pin receiving opening 8 while a fixed or supported end 6B of the composite action beam 6 is located near a solder tail opening 9. The supported end 6B is a part of the stabilizing structure for stabilizing the composite action beam 6. A solder tail 10 of the composite action beam 6 is continuous with the composite action beam 6 at the fixed end 6B and protrudes through the solder tail opening 9. The solder tail 10 bends 90° around a bottom of the sidewall 4 and extends horizontally beyond the sidewall 4.

Still referring to FIG. 1A, the movable end 6A makes a contact with the pin 2 during an initial phase of an insertion cycle. The angle of attack by the pin 2 with respect to the movable end 6A may be relatively high during this initial phase, compared to later phases of the insertion cycle. In a preferred embodiment, the movable side 6A is located to one side of the pin receiving opening 8 during this phase of insertion. The center of arch 6C of the composite action beam 6 may abut against the insertion wall 5. The pin-receiving opening 8 may be partially further indented on a surface 4A facing the movable end 6A. The deflection rate during the initial phase may be approximately 159 grams force per mm according to a preferred embodiment of the current invention. The movable end 6A functions as a cantilever beam and requires low insertion force during this initial phase.

Figure 1C:
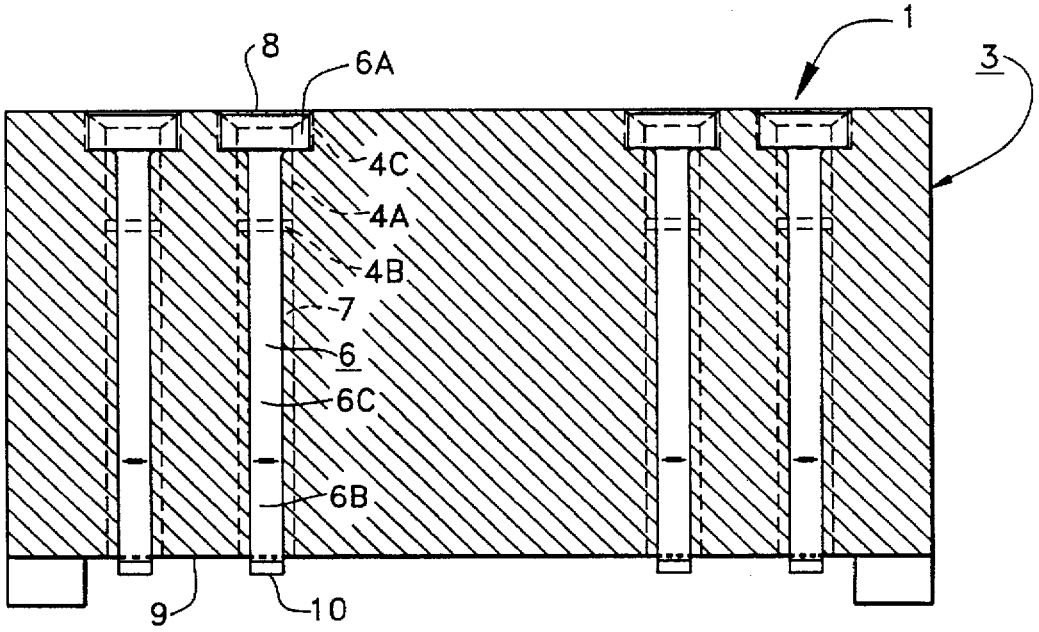
FIG. 1C shows another cross-sectional view of the miniature connector at 1C—1C of FIG. 1B.
Figure 1B:
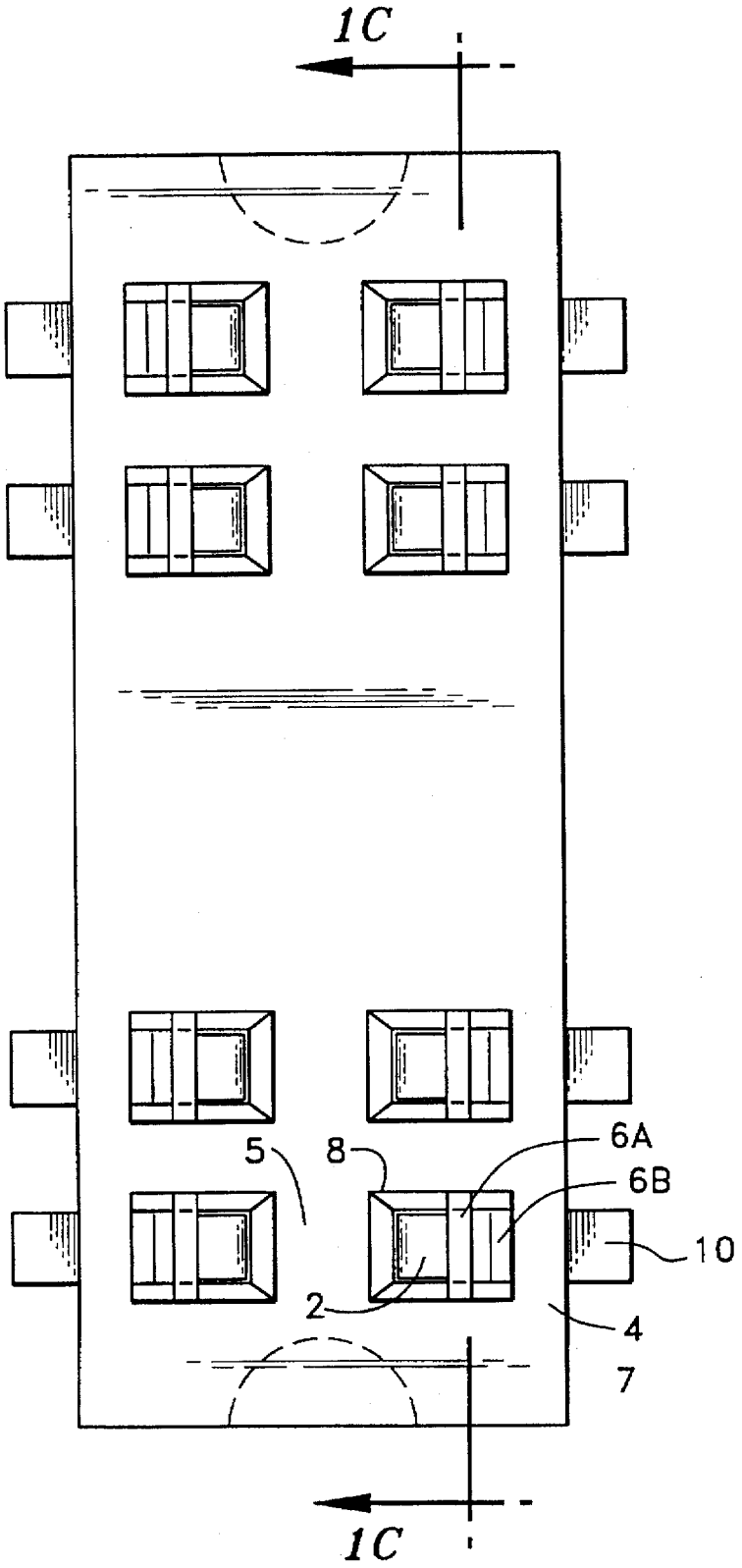
FIG. 1B diagrammatically illustrates a top view of the miniature connector of the current invention.

Now referring to FIG. 1B, relative locations of the above discussed components in the compact connector according to the current invention are shown in a top view. In a pin-receiving opening 8, the pin 2 is shown in the most inner part against the insertion wall 5. The pin 2 contacts the movable end 6A of the composite action beam 6 in an approximately center location of the pin receiving opening 8. Lateral to the movable end 6A is a space 7 and the fixed end 6B which abuts the sidewall 4. Further lateral to the sidewall 4 is a portion of the solder tail 10, which extends beyond the sidewall 4. In the embodiment shown in FIG. 1B, there are eight pin-to-beam contacts on the connector. It is noted, however, that such a connector feature would most likely be applicable in high pin count configurations.

FIG. 1C shows another cross-sectional view of the miniature connector at 1C—1C of FIG. 1B. The pin-receiving opening 8 has a larger diameter than the width of the composite action beam 6. The bore 7 indicated by a dotted line is limited by the inside walls of the connector 3. The composite action beam 6 shown in solid line has the movable end 6A near the pin-receiving opening 8, the arch portion 6C near the center of the bore 7 and the fixed end 6B near the solder tail opening 9. The solder tail 10 is contiguous with the fixed end 6B. The indented surface 4A further comprises a transition area 4B between the indented surface 4A and the inner surface of the side wall 4. The indented surface further comprises movable area 4C where a movement of the movable end 6A of the composite action beam 6 is accommodated. Thus, the movable end of the composite action beam 6 is guided within movable area 4C of the indented surface 4A so as to minimize the deviation from a predetermined course of movement. In a preferred embodiment, the width of the movable end 6A and the corresponding moveable area 4C is wider than the rest of the composite action beam 6 or the bore 7. This wide movable end area 6A is defined as a guiding structure for guiding the movement of the movable end of the composite action beam. This width differentiation prevents the moveable end 6A of the composite action beam from being pushed down towards the fixed end 6B so as to maintain its substantially horizontal movement near the pin-receiving opening 8 during the pin insertion cycle.

It will be noted in FIG. 1A, that solder tail opening 9 is filled. In such a construction it may not be necessary to provide movable end 6A with a portion that is wider than the composite action beam 6 or bore 7. Similarly, if movable end 6A is constructed as shown, it may not be necessary to fill solder tail opening 9. One advantage to filling solder tail opening 9 is the prevention of solder from flowing into bore 7 during mounting of the connector.

Figure 2:
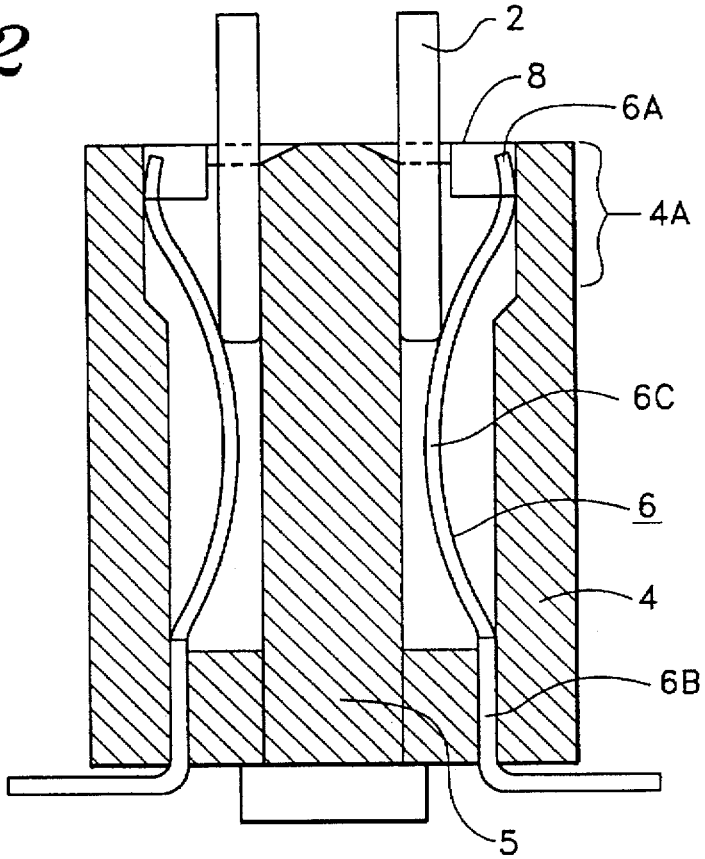
FIG. 2 shows a cross-sectional view of the miniature connector as in FIG. 1A and a pin during an intermediate phase of the insertion cycle.

FIG. 2 illustrates an intermediate phase of the pin insertion cycle in a preferred embodiment according to the current invention as shown in FIG. 1A. The pin is further inserted towards the center of the arch 6C of the composite action beam 6. To accommodate further insertion, the movable end 6A functions as a cantilever beam, and movable end 6A moves towards the partially indented surface 4A of the sidewall 4. The partially indented surface 4A of the sidewall 4 can serve to narrow the overall width of the connector assembly 1. The movable end then abuts against the partially intended surface 4A as shown in FIG. 2, and the partially indented surface 4A is also defined as a part of stabilizing structure for stabilizing the movable end 6A. At this point, the composite action beam 6 goes through a transition from a cantilever beam to a supported beam. Neither end of the composite action beam 6 no longer horizontally moves to accommodate further pin insertion. However, the center of the arch 6C deflects from this point on. As the center of the arch 6C deflects, the movable end 6A may move in the direction of an axis of insertion toward the pin receiving opening 8. The fixed end 6B of the composite action beam 6 remains stationary with respect to the sidewall 4. Accordingly, the deflection rate may increase up to approximately 635 grams force per mm after the composite beam 6 acts as a two-point supported beam in a preferred embodiment of the current invention.

Figure 3:
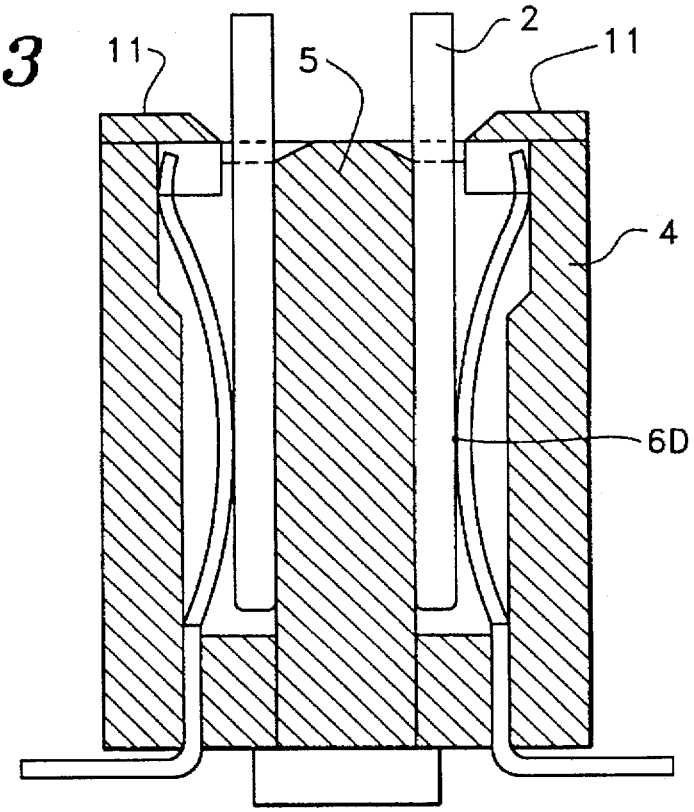
FIG. 3 illustrates a cross-sectional view of the miniature connector and the pin of the current invention as in FIG. 1A after the pin is completely inserted into the connector.

Now referring to FIG. 3, the pin 2 has reached the final insertion point. The pin 2 is pressed against the insertion wall 5 by the composite action beam 6 at a Hertzian stress dot 6D. In this final insertion phase, the composite action beam 6 provides high normal force against the pin 2 relative to initial insertion force so as to retain the pin 2 in the final position. The composite action beam 6 now remains to function as a two-point supported beam.

It will also be noted that an anti-stubbing top 11 has been added to connector 1 which extends over pin receiving opening 8. The function of top 11 is to prevent stubbing of pins 2 on composite beam 6. In order to assist in the insertion of pins 2, the end portion of top 11 extending over pin receiving opening 8 is chamfered or tapered.

In summary, FIGS. 1–3 illustrate a transition of the composite action beam 6 from a cantilever beam to a supported beam. Such a transition in the beam 6 yields low insertion force during an initial phase relative to high normal force against a completely inserted pin. Low insertion force is an advantage for a compact connector. Since the area required for each pin-to-beam contact is smaller with the composite action beam of the current invention, a larger number of the contacts may be placed in the compact connector. Thus, a total amount of insertion force needs to be kept minimal so as to make insertion relatively easy and reliable. The composite action beam of the current invention satisfies such a low insertion force requirement. At the same time, when a pin is completely inserted, sufficiently high normal force against the pin is also provided by the composite action beam of the current invention. Therefore, the composite action beam of the current invention combines the advantageous features of the cantilever beam and the supported beam without sacrificing the space limitation of a compact connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An electrical connector for electrically connecting at least two pins comprising:

a receptacle having at least two bores with an middle wall therebetween, said middle wall having two opposing insertion surfaces, each bore having a corresponding axis, each bore adapted for receiving a corresponding pin, each one of said bores having an inner wall opposite said insertion surface, wherein at least one of said inner walls has a partially indented surface; and a first contact beam and a second contact beam located in a corresponding bore, said first and second contact beams each having an unsupported end and a supported end and a curved arc between said support end and unsupported end extending towards each other and against each respective insertion surface, such that when pins are inserted into respective bores at said unsupported ends during an initial phase of an insertion, each of said contact beams functioning as a cantilever beam so as to allow a substantially low deflection rate and low pin insertion force during said initial phase, further insertion of the pins causing said unsupported ends to reach said inner walls and to slide along said inner walls during later phase of said insertion, thereby retaining said pins within said bores and with each of said contact beams against each respective pin with a substantially high normal force against the respective pin and a relatively low insertion force throughout the entire insertion phase of the respective pin.

2. The electrical connector according to claim 1, wherein at least one of said inner walls is substantially smooth over the length of sliding movement of the free end of the beam thereon.

3. The electrical connector according to claim 1 wherein at least one contact beam has a deflection rate of approximately 159 grams force per mm during said initial phase.

4. The electrical connector according to claim 1 wherein at least one contact beam has a deflection rate of up to approximately 635 grams force per mm during said later phase.

5. The electrical connector according to claim 1 wherein said unsupported end of said contact beam is adapted to slidingly engage said partially indented surface so as to provide an additional space for movement of said unsupported end without increasing an outer width of said receptacle.

6. An electrical connector for electrically connecting at least two pins comprising:

a receptacle having at least two bores with an middle wall therebetween, said middle wall having two opposing insertion surfaces, each bore having a corresponding axis, each bore adapted for receiving a corresponding pin, each bore having an inner wall opposite said insertion surface, at least one of said inner walls having a partially indented surface;

at least two contact beams, each contact beam located in a corresponding bore with at least one of said contact beams having an unsupported end and a supported end and a curved arc between said support end and unsupported end, said curved arc of said contact beams extending towards each other and against each respective insertion surface, such that when pins are inserted into said bores at said unsupported ends during an initial phase of an insertion, each of said contact beams functioning as a cantilever beam so as to allow a substantially low deflection rate during said initial phase, each of said respective unsupported ends reaching said partially indented surface and sliding along said partially indented surface during a later phase of said insertion, each one of said contact beams then functioning as a supported beam during said later phase so as to retain each one of said pins within each one of said respective bores and with the contact beams against each one of said respective pins with a substantially high normal force against the pins;

whereby said partially indented surface providing an additional space for said unsupported end without increasing an outer width of said receptacle.

* * * * *